US006527631B2

(12) United States Patent
Wuensch et al.

(10) Patent No.: US 6,527,631 B2
(45) Date of Patent: Mar. 4, 2003

(54) ELECTRIC HAND POWER GRINDER, IN PARTICULAR ECCENTRIC GRINDER

(75) Inventors: Steffen Wuensch, Holzgerlingen (DE); Werner Neubert, deceased, late of Stuttgart (DE), by Karla Neubert, Kirstin Neubert, executors

(73) Assignee: Robert Bosch GmbH, Stuttgart (DE)

( * ) Notice: Subject to any disclaimer, the term of this patent is extended or adjusted under 35 U.S.C. 154(b) by 21 days.

(21) Appl. No.: 09/804,436

(22) Filed: Mar. 12, 2001

(65) Prior Publication Data

US 2001/0023168 A1 Sep. 20, 2001

(30) Foreign Application Priority Data

Mar. 14, 2000 (DE) ..... 100 12 243

(51) Int. Cl.[7] ..... B24B 23/00
(52) U.S. Cl. ..... 451/357; 451/441; 451/359
(58) Field of Search ..... 451/357, 359, 451/360, 353, 342, 533, 534, 537, 441

(56) References Cited

U.S. PATENT DOCUMENTS

| | | | | | |
|---|---|---|---|---|---|
| 3,875,703 | A | * | 4/1975 | Clemente | 451/359 |
| 3,932,966 | A | * | 1/1976 | Stern | 451/359 |
| 5,018,314 | A | | 5/1991 | Fushiya et al. | |
| 5,109,637 | A | * | 5/1992 | Calafut | 451/495 |
| 5,453,040 | A | * | 9/1995 | Schaal et al. | 451/344 |
| 5,580,302 | A | * | 12/1996 | Howard et al. | 451/357 |
| 5,813,903 | A | * | 9/1998 | Amano et al. | 451/294 |
| 5,931,727 | A | * | 8/1999 | Schadow | 451/355 |
| 6,176,771 | B1 | * | 1/2001 | Gaege | 451/490 |

FOREIGN PATENT DOCUMENTS

| | | |
|---|---|---|
| DE | 296 13 570 U1 | 10/1996 |
| DE | 197 08 086 A1 | 9/1998 |
| EP | 0 112 405 A1 | 7/1984 |
| EP | 0 578 865 A1 | 1/1994 |
| EP | 0 767 031 A1 | 4/1997 |
| WO | 94/08757 | 4/1994 |

* cited by examiner

*Primary Examiner*—George Nguyen
*Assistant Examiner*—Dung Van Nguyen
(74) *Attorney, Agent, or Firm*—Michael J. Striker

(57) ABSTRACT

An electric hand power grinder formed as an eccentric grinder has a grinding plate, a abrasive carrier provided on a lower side of the grinding plate and composed of a soft material, the abrasive carrier being plate-shaped and being fixed on the grinding plate by a surface adhesive means provided on a lower side of the grinding plate and producing a surface adhesive connection with the abrasive carrier.

21 Claims, 2 Drawing Sheets

ELECTRIC HAND POWER GRINDER, IN PARTICULAR ECCENTRIC GRINDER

BACKGROUND OF THE INVENTION

The present invention relates to an electric hand power grinder, in particular an eccentric grinder, and also to abrasive carrier of a soft material for use on a grinding disk of the electric hand power grinder.

In a known eccentric grinder disclosed in U.S. Pat. No. 5,018,314 the abrasive carrier includes a rubber body mounted on a grinding plate and a grinding sheet which contains the abrasive and is alternatingly fixable as a wear part on the lower side of the rubber body. The rubber body is clamped over the outer edge of the grinding plate with a ring groove, which is formed on a bottom of a central opening of the outer thread of the rubber body which faces away from the grinding sheet. In another known vibration grinder disclosed in German document DE 197 08 086 the abrasive carrier which is called there a grinding plate is plate-shaped and mounted by screws on its vibration plate. The abrasive carrier includes a rigid upper plate and a lower plate of a soft material, as well as a grinding-grain containing grinding sheet which is releasably fixed by a flat adhesive connection to the lower plate.

SUMMARY OF THE INVENTION

Accordingly, it is an object of the present invention to provide an electric hand power grinder and an abrasive carrier which have the advantage of making available a grinding tool formed as a wear part which is price favorable and exchangeable fast without an auxiliary tool, so that it can be fast mounted on the grinding plate as well as released, and also optimal grinding results can be provided in different configurations.

A significant extension of the abrasive carrier over the grinding plate of the electric hand power grinder is prevented, so that when it is used up the hard griding plate does not abut against the tool.

When the electric hand power grinder is provided with a grinding dust aspiration, then in accordance with a preferable embodiment of the present invention the grinding plate and the abrasive carrier have congruent openings for aspiration of dust, and at the lower side of the grinding plate ring webs are formed which surround the suction openings of the grinding disk and axially project from it so as to form-lockingly engage into the dust suction openings of the abrasive carrier. With this structural design, the abrasive carrier is very accurately centered on the grinding disc, which contributes to reduction of vibrations in the machine housing.

In accordance with the preferable embodiment of the invention, the abrasive carrier has a support layer which is covered with a counter surface layer, and a grinding sheet which is held on the grinding element and is releasable from the support layer. Therefore between the support layer and the spraying disk, flat adhesive connection is provided whose pealing strength is smaller than the pealing strength of the flat adhesive connection between the grinding disk and the abrasive carrier. In this manner, during the exchange of the used up grinding sheet, the support layer remains adherent to the grinding plate and is not pulled out with it.

Preferably, the flat adhesive element is formed on the grinding disk as a burdock-like structure, which provide a flat adhesive connection with the counter adhesive layer arranged on the abrasive carrier, such as preferably velours or felt, or vice versa.

In accordance with a preferable embodiment of the inventive abrasive carrier, the counter adhesive layer which produces a flat adhesive connection with the flat adhesive element on the grinding plate of the electric hand power grinder is colored, in correspondence with the softness or hardness of the material of the abrasive carrier in a different manner. For example, soft material can be recognized by a red counter adhesive layer, extra soft material can be recognized by a white counter adhesive layer, and a hard material can be recognized by a black counter adhesive layer.

In accordance with a preferable embodiment of the invention, the material of the abrasive carrier can be formed as a grinding grain containing element, and preferably can be formed as an open-pore, grinding grain containing wool or fabric.

In accordance with a preferable embodiment of the invention, in the abrasive carrier two preferably differently colored layers with different grain sizes of the layer material are provided. They can be connected with one another directly or through an intermediate layer of a supporting sheet, for example of moss rubber, unseparably with one another. Depending on the grain size required for the grinding process, the abrasive carrier can be placed on the grinding plate with one or the other layer. Therefore, the surface adhesive element on the grinding plate, despite the grain size of the abrasive carrier side produces a good surface adhesive connection, especially when the two layers of the abrasive carrier are formed as open-pore, grinding grain-containing wool or fabric, and the flat adhesive element is formed as a burdock-type region.

In accordance with a further advantageous embodiment of the invention, the abrasive carrier has a preferably colored, grinding grain containing layer, which is inseparably or separably mounted on a supporting layer which carries the counter adhesive layer. In a preferable embodiment, the grinding-grain containing layer is formed as an open-pore wool or fabric and the supporting layer is composed of moss rubber.

In accordance with an alternative embodiment of the present invention, a further adhesive surface connection is formed between the separable grinding-grain containing layer which is for example composed of a grinding sheet, and a supporting layer which is for example composed of moss rubber. The pealing strength of the further adhesive surface connection is smaller than the pealing strength of the flat adhesive connection between the supporting layer and the grinding layer. In this case the supporting layer can be coated at both sides with velour or with a burdock-type region.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
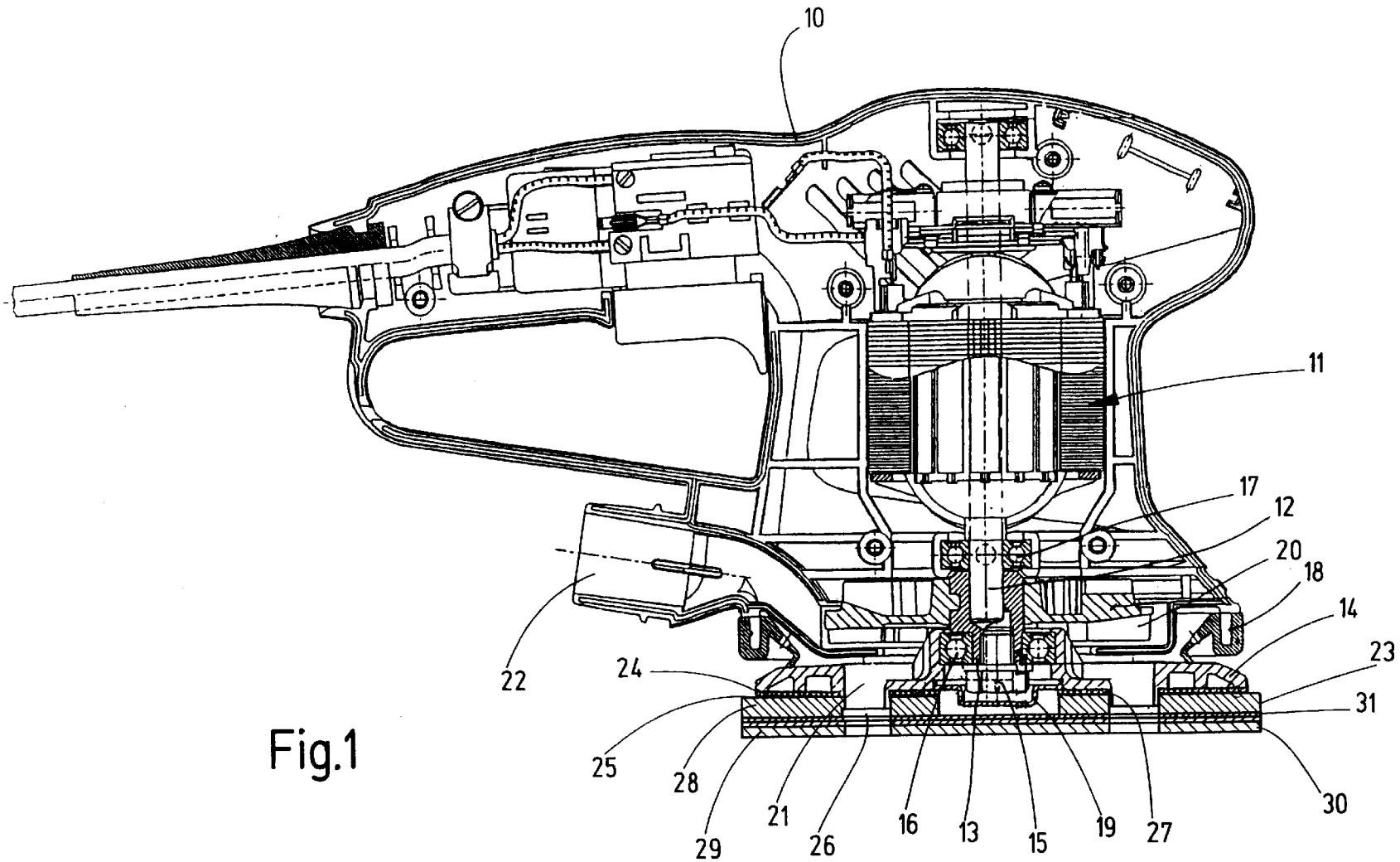
FIG. 1 is a view showing a longitudinal section of an eccentric grinder with an abrasive carrier in accordance with a first embodiment of the present invention.

An eccentric grinder which is shown in a longitudinal section in FIG. 1 is illustrated in an exemplary form in general as an electric hand power tool, which for example can be formed as a vibration grinder. The eccentric grinder has a housing 10, and an electric motor 11 which is located in the housing and drives a grinding plate 14 through an eccentric 13 which is mounted on its rotor shaft 12. The grinding plate 14 is axially fixed on the eccentric 13 by a mounting screw 15 which is screwed in from the end side. It is supported on the eccentric 13 through a ball bearing 16 which is integrated in the grinding plate 14, while the rotor shaft 12 is supported in the housing 10 by a ball bearing 17.

A rubber 18 is arranged on the lower side of the housing 10 which faces the grinding plate 14. It is used for braking the grinding plate 16 so that it protects the housing 10 from damages at its maximum diameter. For lowering the manufacturing costs, the electric motor 11 is designed without a longitudinal insulation, without over rotating collector, with unbalanced rotor and not mush armature winding as well as with a smooth rotor shaft without steps and without centering. In order to guarantee the above described protective insulation, the mounting screw 15 is covered by a cap 19 which is non releasably held in the grinding plate 14 and can be removed only by destruction. A fan 20 is mounted on the rotor shaft 12 for dust aspiration. It aspirates air from the lower side of the grinding plate 14 through dust aspiration openings 21 in the grinding plate 14, and transports it to an air outlet pipe 22 which is conventionally connected to a dust catching filter. The dust aspiration openings 21 are arranged so that they are offset relative to one another on a partial circle at equal peripheral angles. Each dust aspirating opening 21 is closed by a ring web 27, which axially projects on the lower side of the grinding plate 14.

A plate-shaped abrasive carrier 27 is designed for grinding treatment of workpieces as a wear part. It is releasably mounted on the lower side of the grinding plate 14. For this purpose the lower side of the abrasive carrier 23 is covered with a surface adhesive element 24, for example a burdock-like region. The flat adhesive element 24 together with the counter adhesive layer 25 which covers a plate surface of the abrasive carrier 23 and is composed for example of wool or fabric, provides a flat adhesive connection between the grinding plate 14 and the abrasive carrier 23. Aspirating openings 26 are provided in the abrasive carrier 23 in the same way as in the grinding plate 14. With the proper placement of the abrasive carrier 23 on the grinding plate 14 the dust aspiration openings 26 are coaxial with the dust aspiration openings 21 in the grinding plate 14.

In the embodiment shown in FIG. 1, the abrasive carrier 23 has a carrier layer 28 which carries the counter adhesive layer 25, and the grinding sheet 29 which contains the abrasive and is releasable from the carrier layer 28. The grinding sheet 29 is releasably fixed, through a surface adhesive connection, on the side of the carrier layer 28 which faces away from the counter adhesive layer 25. The pealing strength of the surface adhesive connection between the carrier layer 28 and the grinding sheet 29 is smaller than the pealing strength of the flat adhesive connection between the abrasive carrier 23 and the grinding plate 14. Therefore, during exchange of the used grinding sheet 29 the abrasive carrier 23 remains adhesively connected to the grinding plate 14 and is not pulled out.

The surface adhesive connection between the carrier layer 28 and the grinding sheet 29 is performed by a burdock-type region 30 which covers the grinding sheet 29, and a counter adhesive region 31 which covers the carrier layer 28 and formed for example of velour or felt, or vice versa. The abrasive carrier 23 is composed of a soft material and projects from the grinding plate 14 substantially, so as to prevent that when the abrasive carrier 23 is used up, the hard grinding plate 14 laterally abuts against the workpiece. For optimization of the grinding process, the abrasive carrier 23 can be formed of different materials, for example soft, extra soft or hard. In order to recognize the softness or hardness of a abrasive carrier 23, the counter adhesive layer 25 composed for example of velour can be colored. For example the color could be read for a soft grind medium carrier 23, the color can be white for an extra soft abrasive carrier, and the cover can be black for a hard abrasive carrier 23.

FIGS. 2–5 show further embodiments of the abrasive carrier 23, in a section and in schematic representation.

Figure 2:
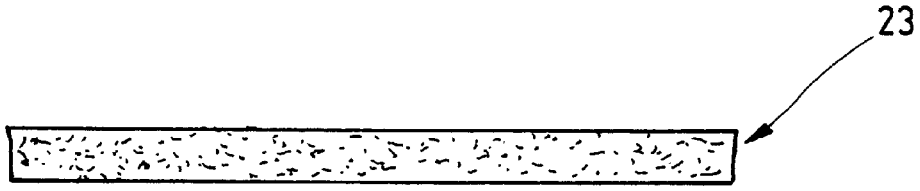
FIGS. 2–5 are views showing a cross-section of the abrasive carrier of FIG. 1, in accordance with the further embodiments.

In the abrasive carrier 23 shown in FIG. 2 the whole material is grinding-grain containing, and simultaneously forms a counter adhesive layer for producing the surface adhesive connection with the abrasive carrier 23. For example, for this purpose the abrasive carrier 23 can be formed as open-pore, grinding-grain containing wool or fabric.

Figure 3:
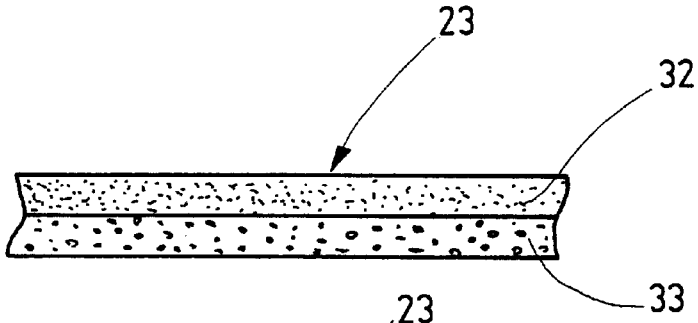

The abrasive carrier 23 shown in FIG. 3 is assembled of inseperable tool-grinding containing layer 32, 33 with different grain sizes. Also, here for each layer an open-pore, grinding grain-containing wool or fabric can be utilized. Therefore by, pressing the abrasive carrier 23 against the flat adhesive medium 24, a flat adhesive connection is produced.

Figure 4:
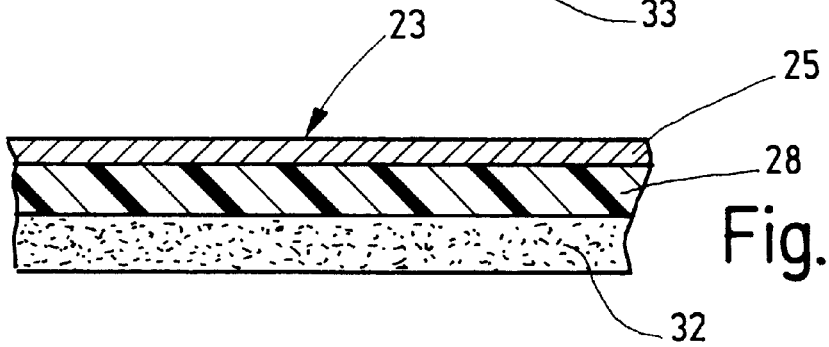

In the embodiment of FIG. 4, the abrasive carrier 23 has a carrier layer 28, for example of moss rubber, as well as a grinding grain-containing layer 32 for example of wool or fabric, which is inseparably arranged on the carder layer 28. The carrier layer 28 is provided with the counter adhesive layer 25 at its side facing away from the grinding grain-containing layer 32.

Figure 5:
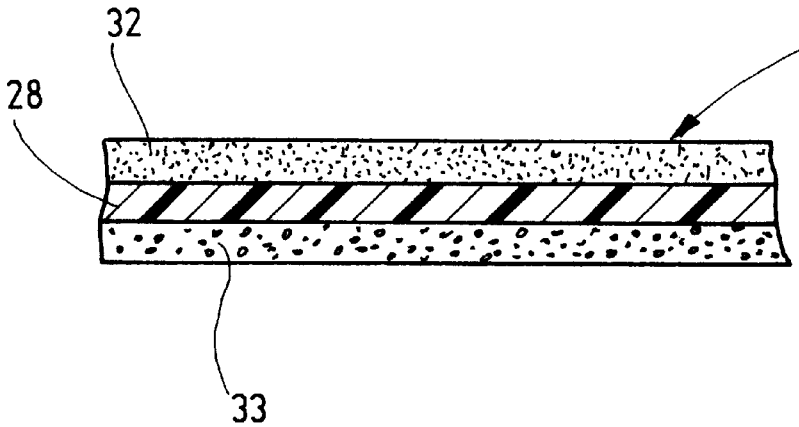

In the embodiment of FIG. 5, on each side of a carrier layer 28, a grinding grain-containing layer 32, 33 is applied inseparably. The both layers 32, 33 have different grain sizes. Both layers 32, 33 can be formed by an open-pore, grain-containing wool or fabric. Therefore, by placing the abrasive carrier 23 with the other layer 32, 33 on the lower side of the grinding plate 14, the available wear surface adhesive means 24 provide a flat adhesive connection to the abrasive carrier 23. Depending on the application, the abrasive carrier 23 can be utilized with the layers 33 of greater grain size, or the layers 32 of smaller grain size, for grinding corresponding workpieces.

It will be understood that each of the elements described above, or two or more together, may also find a useful application in other types of constructions differing from the types described above.

While the invention has been illustrated and described as embodied in Electric Hand Power Grinder, in Particular Eccentric Grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An electric hand power grinder formed as an eccentric grinder, comprising a grinding plate; a carrier for abrasive means provided on a lower side of said grinding plate and composed of a soft material, said carrier being plate-shaped and being releasably fixed on said grinding plate by a surface adhesive means provided on a lower side of said grinding plate and producing a surface adhesive connection with said carrier, wherein said grinding plate and said carrier have coinciding openings for aspiration of dust, said grinding plate having a lower side provided with ring webs which surround said dust aspirating openings of said grinding plate and are spaced from said openings and which form-lockingly engage in said dust aspirating openings in said carrier.

2. An electric hand power grinder as defined in claim 1, wherein said surface adhesive means on said grinding plate is formed as a burdock region, said carrier being provided with a counter adhesive layer which forms together with said burdock region a surface adhesive connection.

3. An electric hand power grinder as defined in claim 2, wherein said counter adhesive layer is composed of an adhesive material.

4. An electric hand power grinder as defined in claim 2, wherein said counter adhesive layer is composed of a material selected from the group consisting of velour and felt.

5. He An electric hand power grinder as defined in claim 2, wherein said carrier has a carrier layer provided with said counter adhesive layer, and also a grinding sheet which contains grinding means and is releasable from said carrier layer, so that between said carder layer and said grinding sheet a surface adhesive connection is formed which has a smaller pealing strength than a pealing strength of said surface adhesive connection between said grinding plate and said carrier.

6. An electric hand power grinder as defined in claim 5, wherein said surface adhesive connection between said grinding sheet and said carrier sheet includes a burdock region which coats one or said grinding sheet and said carrier layer and a counter adhesive region which coats the other of said grinding sheet and said carrier layer.

7. An electric hand power grinder as defined in claim 6, wherein said counter adhesive region is composed of a material selected from a group consisting of velour and felt.

8. A carrier for abrasive means composed of a soft material and usable on a grinding disc of an electric hand power grinder formed as an eccentric grinder, the carrier comprising a flat plate adapted to substantially correspond to a shape of the grinding disc with an extension outwardly beyond an edge of the grinding disc, said plate having at least one plate side having a surface adhesive property for producing a flat adhesive connection with a flat adhesive medium provided on the grinding disc, wherein said carrier for abrasive means has dust aspirating openings, wherein said dust aspirating openings press-fit around tubular ring webs of said grinding disc.

9. A carrier as defined in claim 8, wherein the flat adhesive property of said plate is formed by a counter adhesive layer which is arranged on an upper side of said plate and substantially corresponds to a surface adhesive medium on said grinding disk, said counter adhesive layer being colored in correspondence with a softness or hardness of a material of said plate.

10. A carrier as defined in claim 9, wherein said plate is composed of a grinding grain containing material.

11. A carrier as defined in claim 9, wherein said plate is composed of an open-pore grinding-grain containing wool.

12. A carrier as defined in claim 8, and further comprising two grinding grain-containing layers with different grain sizes, which are inseparably connected with one another.

13. A carrier as defined in claim 12, wherein said grinding-grain containing layers are colored in different colors.

14. A carrier as defined in claim 12, wherein said grinding-grain containing layers are connected with one another directly.

15. A carrier as defined in claim 12, wherein said grinding-grain containing layers are connected with one another with an interposition of a carrier layer.

16. A carrier as defined in claim 15, wherein said carrier layer is composed of moss rubber.

17. A carrier as defined in claim 8, and further comprising a grinding-grain containing layer which is applied on a carrier layer.

18. A carrier as defined in claim 17, wherein said grinding-grain containing layer is colored.

19. A carrier as defined in claim 17, wherein said grinding grain containing layer is composed of wool.

20. A carrier as defined in claim 17, wherein said grinding grain containing layer is mounted on said carrier layer in a manner selected from the group consisting of separable mounting and inseparable mounting.

21. A carrier as defined in claim 17, wherein said carrier layer is composed of moss rubber.

* * * * *